US009733602B2

(12) United States Patent
Oki

(10) Patent No.: US 9,733,602 B2
(45) Date of Patent: Aug. 15, 2017

(54) IMAGE FORMING APPARATUS CAPABLE OF PERFORMING DUPLEX ALIGNMENT WITHOUT PRODUCING A WASTE SHEET

(71) Applicant: KONICA MINOLTA, INC., Chiyoda-ku, Tokyo (JP)

(72) Inventor: Makoto Oki, Hino (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/212,439

(22) Filed: Jul. 18, 2016

(65) Prior Publication Data

US 2017/0038717 A1 Feb. 9, 2017

(30) Foreign Application Priority Data

Aug. 6, 2015 (JP) ..... 2015-155601

(51) Int. Cl.
*G03G 15/00* (2006.01)

(52) U.S. Cl.
CPC ..... *G03G 15/50* (2013.01)

(58) Field of Classification Search
CPC ..... G03G 15/50; G03G 15/5062
USPC ..... 399/49, 72, 82
See application file for complete search history.

(56) References Cited

U.S. PATENT DOCUMENTS 5,631,747 A * 5/1997 Farrell et al. ..... H04N 1/3873 358/401
8,964,246 B2 * 2/2015 Sakatani ..... G03G 15/5062 399/49
2010/0328722 A1 12/2010 Yasunaga
2014/0022609 A1 1/2014 Tanigawa et al.

FOREIGN PATENT DOCUMENTS

| | | | |
|---|---|---|---|
| JP | 2008-064840 | A | 3/2008 |
| JP | 2008-275991 | A | 11/2008 |
| JP | 2011-011367 | A | 1/2011 |
| JP | 2012-150413 | A | 8/2012 |
| JP | 2013-215962 | A | 10/2013 |
| JP | 2014-022919 | A | 2/2014 |

OTHER PUBLICATIONS

Notification of Reasons for Refusal dated Jun. 20, 2017 issued by the Japanese Patent Office in corresponding Japanese Patent Application No. 2015-155601 and English language translation (8 pages).

* cited by examiner

*Primary Examiner* — William J Royer
(74) *Attorney, Agent, or Firm* — Buchanan Ingersoll & Rooney PC

(57) ABSTRACT

An image forming apparatus includes an image forming device, a trim mark adder, a duplex alignment mark adder and a hardware processor. The image forming device is capable of forming an image on both sides of a sheet based on an image data. The trim mark adder adds trim mark information to the image data so that a trim mark is formed at a trimming position of the sheet. The duplex alignment mark adder adds duplex alignment mark information to the image data so that a duplex alignment mark is formed in a margin area between an edge of the sheet and the trimming position on both sides of the sheet. The hardware processor performs a duplex alignment of the image data based on a result of scanning the duplex alignment mark.

18 Claims, 5 Drawing Sheets

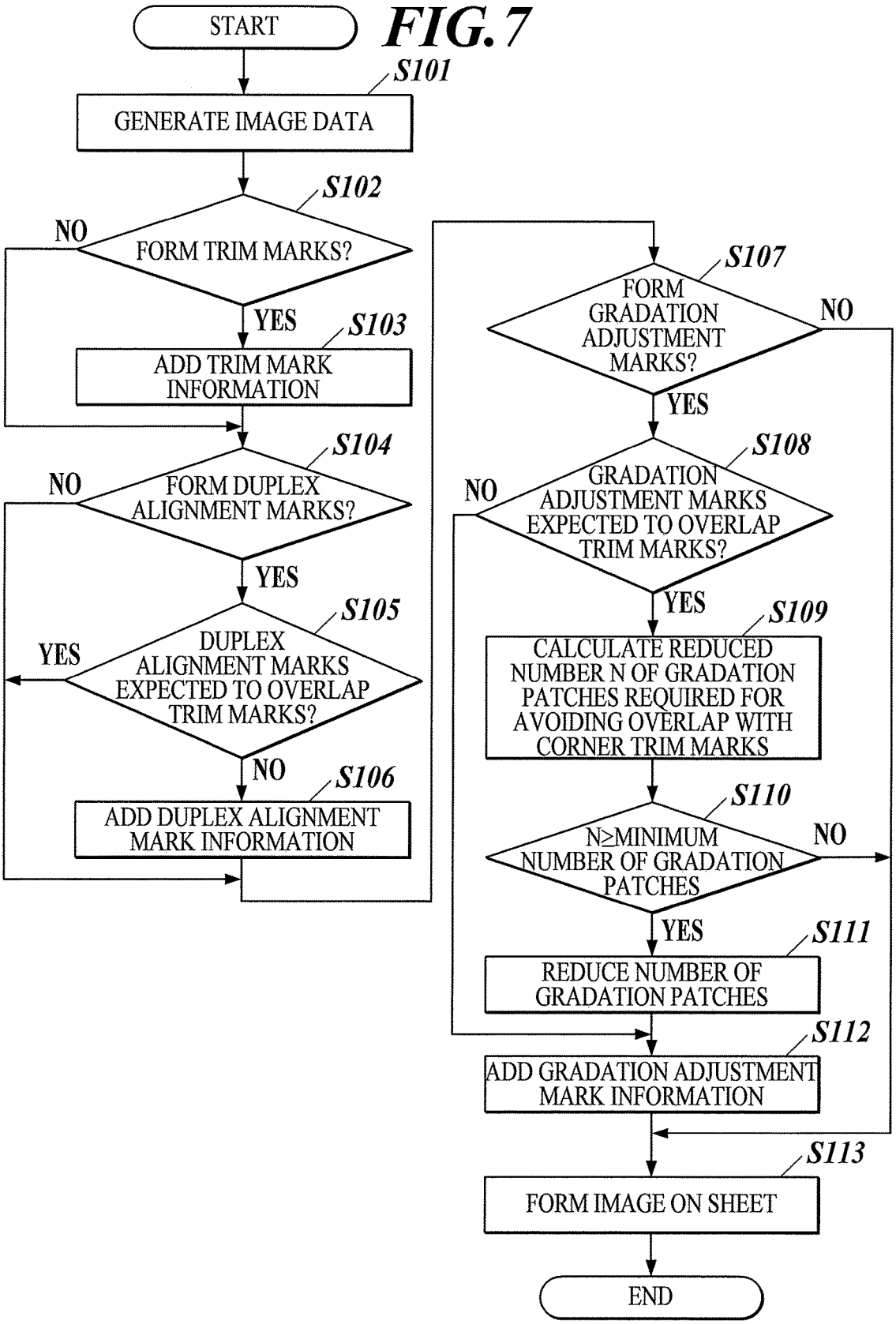
FIG. 7
START
S101
GENERATE IMAGE DATA
S102
FORM TRIM MARKS?
NO
YES
S103
ADD TRIM MARK INFORMATION
S104
FORM DUPLEX ALIGNMENT MARKS?
NO
YES
S105
DUPLEX ALIGNMENT MARKS EXPECTED TO OVERLAP TRIM MARKS?
YES
NO
S106
ADD DUPLEX ALIGNMENT MARK INFORMATION
S107
FORM GRADATION ADJUSTMENT MARKS?
NO
YES
S108
GRADATION ADJUSTMENT MARKS EXPECTED TO OVERLAP TRIM MARKS?
NO
YES
S109
CALCULATE REDUCED NUMBER N OF GRADATION PATCHES REQUIRED FOR AVOIDING OVERLAP WITH CORNER TRIM MARKS
S110
N≥MINIMUM NUMBER OF GRADATION PATCHES
NO
YES
S111
REDUCE NUMBER OF GRADATION PATCHES
S112
ADD GRADATION ADJUSTMENT MARK INFORMATION
S113
FORM IMAGE ON SHEET
END

IMAGE FORMING APPARATUS CAPABLE OF PERFORMING DUPLEX ALIGNMENT WITHOUT PRODUCING A WASTE SHEET

BACKGROUND OF THE INVENTION

1. Field of the Invention

The present invention relates to an image forming apparatus.

2. Description of Related Art

Image forming apparatuses that can perform duplex printing such as printers and copiers have been provided.

In duplex printing, it is required to precisely align the image forming positions in the front and back sides. In particular, when a sheet is trimmed after duplex printing, a misalignment between the front and back image forming positions may result in a failure in which the image on either side is partly lost in the edge part thereof after the trimming.

To cope with the problem, a duplex alignment function by using a dedicated chart has been proposed (e.g. see JP 2014-22919A). Specifically, the distance from the edge of a sheet to a duplex alignment mark of the dedicated chart is measured in each side, and the front and back image forming positions are aligned with each other. However, this technique requires outputting the dedicated chart on a sheet, and a waste sheet is therefore produced in every alignment.

On the other hand, a function of forming trim marks for an input image has been proposed (e.g. JP 2011-11367A). A possible strategy of eliminating a waste sheet is to utilize such trim marks for the duplex alignment.

SUMMARY OF THE INVENTION

However, since such trim marks are formed adjacent to the image area of the image on the sheet, they may be away from the edge of the sheet depending on the size of the sheet and the size of the image formed on the sheet. Such a long distance from the edge of the sheet may cause degradation of measurement accuracy, which is due to the distortion of a line scanner used as a distance measuring means or the like.

It is an object of the present invention to provide an image forming apparatus that can perform duplex alignment with high accuracy without producing a waste sheet.

In order to realize the above object, according to a first aspect of the present invention, there is provided an image forming apparatus, including:

an image forming device which is capable of forming an image on both sides of a sheet based on an image data;

a trim mark adder which adds trim mark information to the image data so that a trim mark is formed at a trimming position of the sheet on which the image is formed based on the image data;

an duplex alignment mark adder which adds duplex alignment mark information to the image data so that a duplex alignment mark is formed in a margin area between an edge of the sheet and the trimming position on both sides of the sheet to which the image is formed based on the image data;

a hardware processor which performs a duplex alignment of the image data based on a result of scanning the duplex alignment mark, in which a scanning section which reads the image formed on the sheet scans the duplex alignment mark.

According to a second aspect of the present invention, there is provided a non-transitory computer readable medium storing a program that makes a computer of an image forming apparatus capable of forming an image on both sides of a sheet according to an image data function as:

a trim mark adder which adds trim mark information to the image data so that a trim mark is formed at a trimming position of the sheet on which the image is formed based on the image data;

a duplex alignment mark adder which adds duplex alignment mark information to the image data so that a duplex alignment mark is formed in a margin area between an edge of the sheet and the trimming position on both sides of the sheet on which the image is formed based on the image data; and a hardware processor which performs a duplex alignment of the image data based on a result of scanning the duplex alignment mark, in which a scanning section which reads the image formed on the sheet scans the duplex alignment mark.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein:

FIG. 7 is a flowchart of an example of image formation processing.

DETAILED DESCRIPTION OF THE PREFERRED EMBODIMENT

Hereinafter, embodiments for carrying out the present invention will be described with the drawings. While the following embodiments include a variety of limitations that are technically preferred for carrying out the present invention, it is not intended that the scope of the present invention is limited to the following embodiments and illustrated examples.

Figure 1:
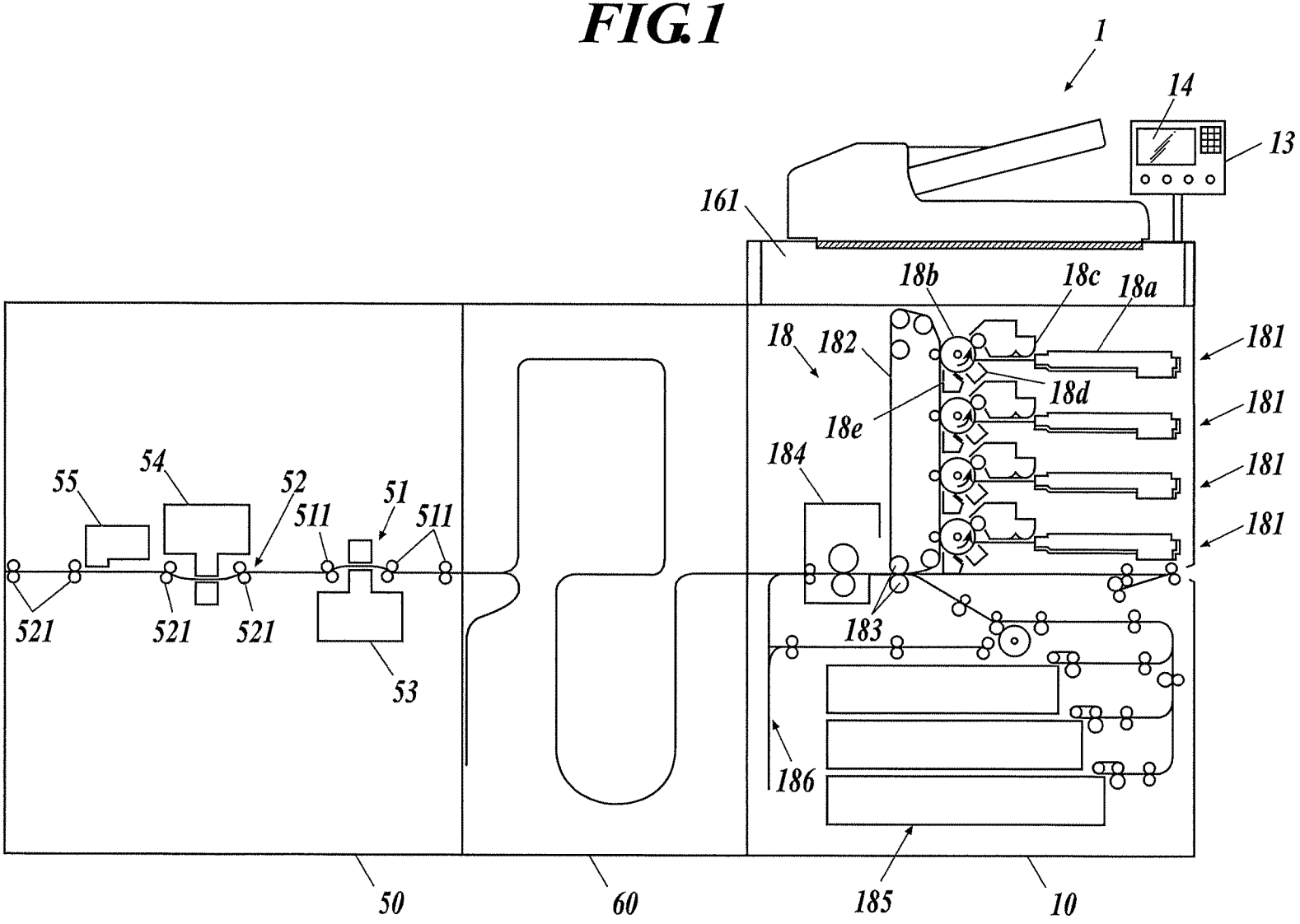
FIG. 1 is a schematic view of an image forming system according to the present invention, illustrating the overall configuration thereof.
Figure 2:
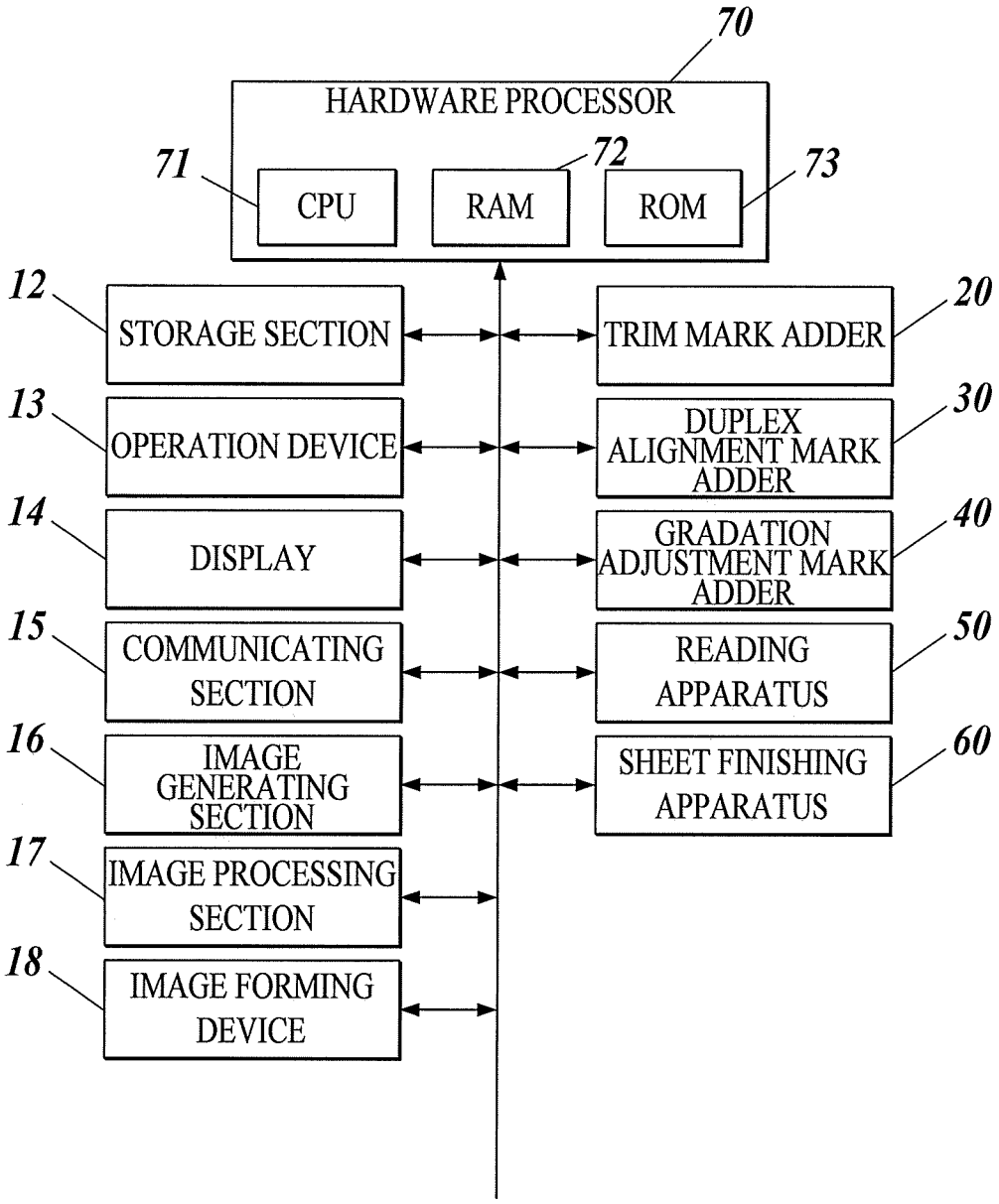
FIG. 2 is a block diagram of an operation control of the image forming system of FIG. 1, illustrating the main configuration thereof.

FIG. 1 is a schematic view of an image forming system 1 according to this embodiment, illustrating the overall configuration thereof. FIG. 2 is a block diagram of an operation control of the image forming system 1, illustrating the main configuration thereof.

As illustrated in FIG. 1 and FIG. 2, the image forming system 1 includes an image forming apparatus 10, a reading apparatus (scanning section) 50, a sheet finishing apparatus 60 and the like.

Hereinafter, the components of the image forming system 1 of the present invention will be individually described.

First, an image forming apparatus 10 will be described.

When the margin area around the image formed on a sheet will be removed through a trimming process outside the image forming apparatus 10 of the present invention, it forms trim marks at the trimming position as well as duplex alignment marks and gradation adjustment marks in the margin area. Further, the image forming apparatus 10 adjusts the position and the gradation of the images formed on both sides of the sheet by using the result of scanning the sheet on which these marks are formed.

As used herein, trim marks refer to guide marks that are formed in the periphery of the image area of the sheet for trimming the sheet on which the images are formed.

For example, the image forming apparatus 10 includes a storage section 12, an operation device 13, a display 14, a communicating section 15, an image generating section 16, an image processing section 17, an image forming device 18, a trim mark adder 20, a duplex alignment mark adder 30, a gradation adjustment mark adder 40, a hardware processor 70 and the like.

The storage section 12 stores a program readable by the hardware processor 70, a file used in executing the program and the like.

The storage section 12 may be constituted by a high-capacity memory such as a hard disk drive.

The operation device 13 generates an operation signal according to a user operation and outputs it to the hardware processor 70. The operation device 13 is constituted by, for example, keys, a touch panel integrally formed with the display 14 or the like. For example, the operation device 13 is used when a user selects whether to form the trim marks, duplex alignment marks or gradation adjustment marks.

The display 14 displays an operation screen and the like according to a control of the hardware processor 70. The display 14 may be constituted by an LCD (liquid crystal display), an OLED (organic electro luminescence display) or the like.

The communicating section 15 communicates with an external device in the network such as a user terminal, a server and another image forming apparatus.

For example, the communicating section 15 receives a data in the form of a page description language (PDL) (hereinafter referred to as a PDL data) from a user terminal through a network.

The image generating section 16 rasterizes the PDL data received from the communicating section 15 and generates a bitmap image data with respect to each color of C (cyan), M (magenta), Y (yellow) and K (black), which contains the gradation level of each pixel. A gradation level is a data value that represents the density of an image. For example, an 8-bit data value represents a density level of from 0 to 255.

As illustrated in FIG. 1, the image forming apparatus 10 includes an image reading section 161 for copying. The image forming apparatus 10 can also generate respective image data of R, G and B colors by reading the image of a user-mounted original by means of the image reading section 161.

The image data are generated from a data received by the communicating section 15 or an image read by the image reading section 161.

The image processing section 17 performs image processing such as color correction processing and halftone processing on the image data generated by the image generating section 16. Further, the image processing section 17 can perform color conversion on the image data of R (red), G (green) and B (blue) colors generated by the image reading section 161 so as to generate respective image data of C, M, Y and K colors.

The color correction processing is to convert the respective gradation levels of C, M, Y and K colors to respective corrected gradation levels of C, M, Y and K colors so that the colors in the image formed on a sheet agree with target colors. In the color correction processing, a gradation correction table is used in which output gradation levels are specified for respective input gradation levels.

The halftone processing is, for example, error diffusion, screening by ordered dithering or the like.

The image forming device 18 forms a multicolor image on a sheet based on the gradation levels of each pixel in the image data that have been subjected to the image processing by the image processing section 17. In the present invention, the image forming device 18 forms an image on a sheet based on the image data that additionally contain trim mark information, duplex alignment mark information and gradation adjustment mark information, which will be described later.

As illustrated in FIG. 1, the image forming device includes four writing units 181, an intermediate transfer belt 182, secondary transfer rollers 183, a fixing device 184, a sheet feeding trays 185 and a flipping mechanism 186. The writing units 181 are arranged in series along the belt surface of the intermediate transfer belt 182. The intermediate transfer belt 182 is supported and driven by rollers. One of these rollers serves as one of the secondary transfer rollers 183. The secondary transfer rollers 183 and the fixing device 184 are arranged in a conveyance path of a sheet conveyed from the sheet feeding trays 185. The sheet feeding trays 185 store sheets.

The four writing units 181 form respective color images of C, M, Y and K colors. Each of the writing units 181 has the same configuration and includes an exposing section 18*a*, a photoreceptor 18*b*, a developing section 18*c*, a charging section 18*d* and a cleaning section 18*e*.

Each of the writing units 181 applies a voltage to the photoreceptor 18*b* to charge it by means of the charging section 18*d* and thereafter emits a laser beam by means of the exposing section 18*a* according to the gradation level of each pixel in the C, M, Y or K color image, so as to expose the photoreceptor 18*b*. Each of the writing units 181 feeds color material such as toner by means of the developing section 18*c* so as to develop an electrostatic latent image formed on the photoreceptor 18*b*. The respective color images are thus formed on the photoreceptors 18*b* of the writing units 181.

The images on the photoreceptors 18*b* are sequentially transferred and overlaid on the intermediate transfer belt 182 so that a multicolor image is formed on the intermediate transfer belt 182. After transferring the images, the writing units 181 remove the residual color material left on the photoreceptors 18*b* after the transfer by means of the cleaning sections 18*e*.

A sheet is fed from the sheet feeding trays 185, the secondary transfer rollers 183 transfer the multicolor image from the intermediate transfer belt 182 to the sheet, and the fixing device 184 then heats and presses the sheet so as to fix the image on the sheet. When images are formed on both sides of the sheet, the flipping mechanism 186 flips over the sheet, and the flipped sheet is conveyed to the secondary transfer rollers 183 again.

Figure 3:
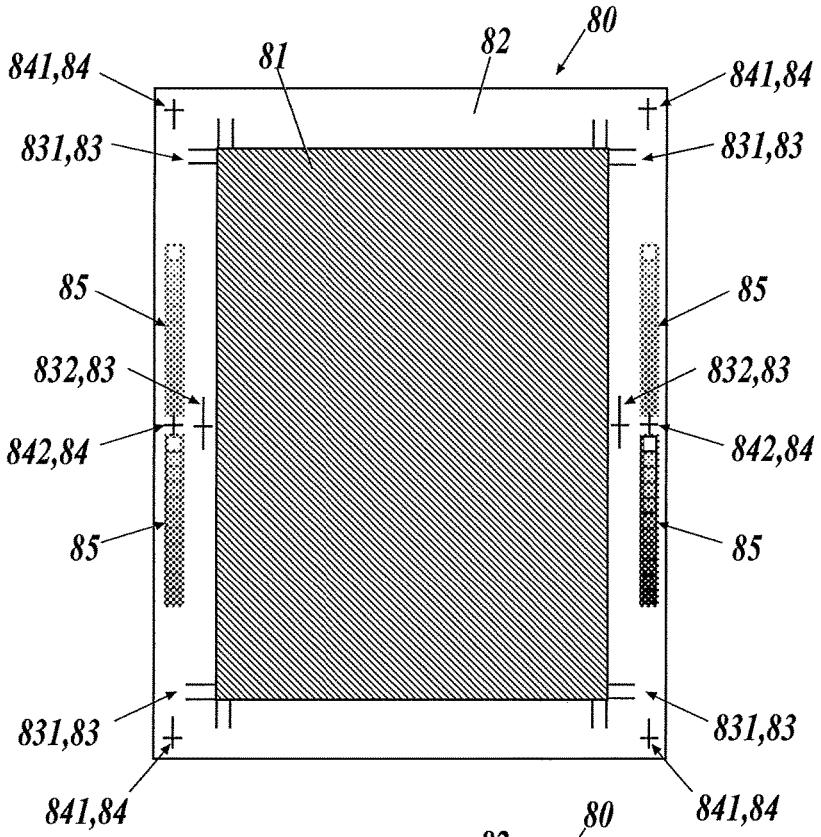
FIG. 3 illustrates various marks formed on a sheet.
Figure 4:
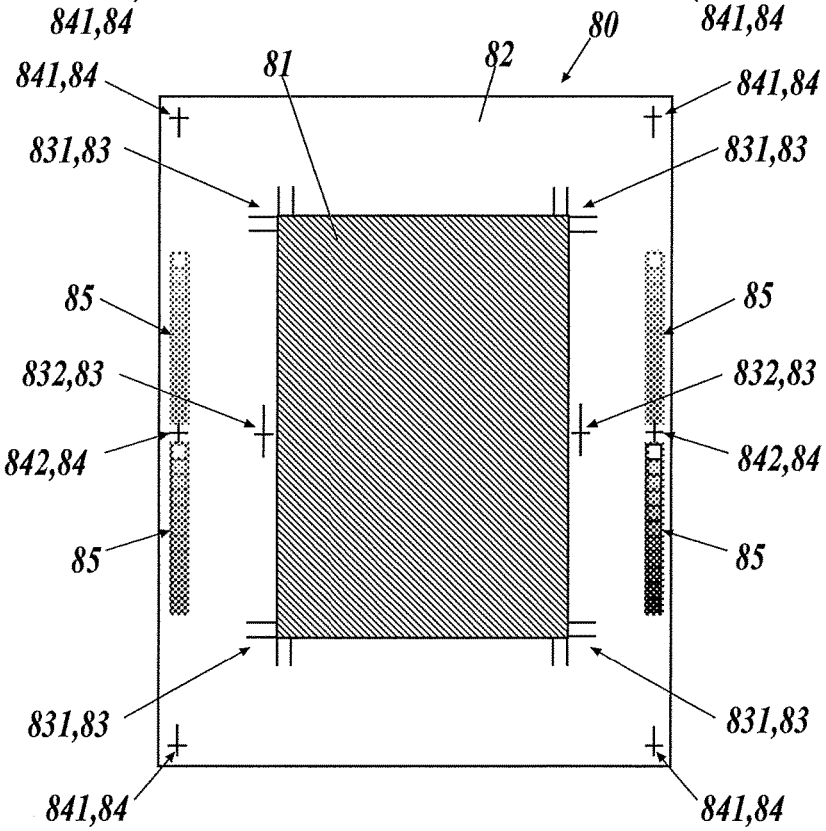
FIG. 4 illustrates the marks when an image area is small relative to the size of the sheet.
Figure 5:
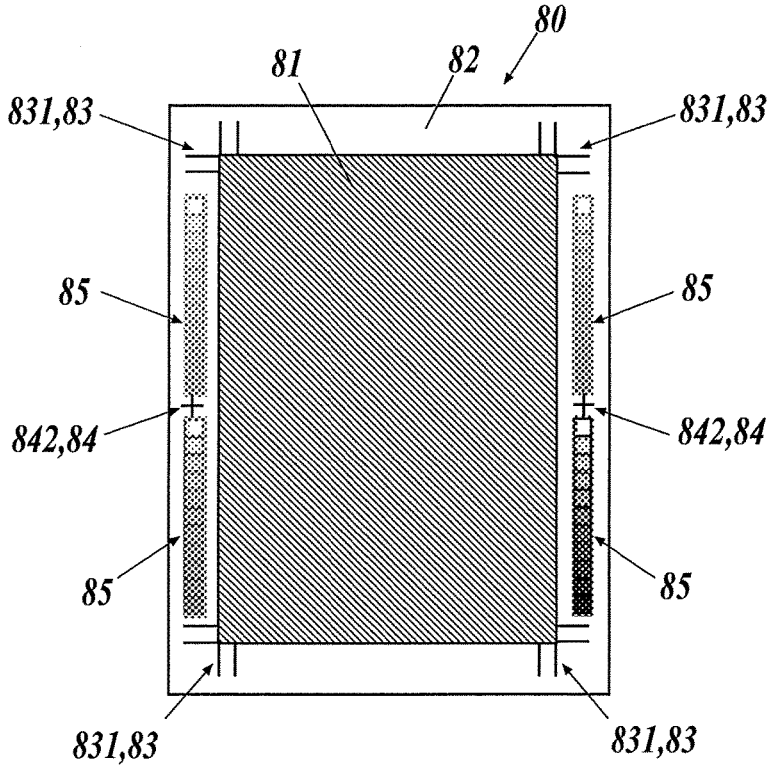
FIG. 5 illustrates the marks when the image area is large relative to the size of the sheet.
Figure 6A:
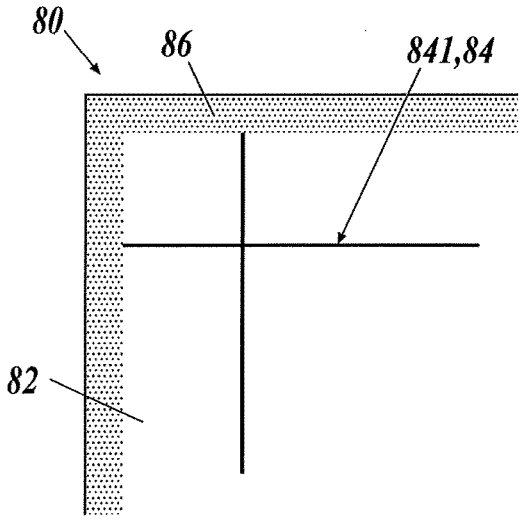
FIG. 6A is an enlarged view of a duplex alignment mark formed in the upper left of a sheet.
Figure 6B:
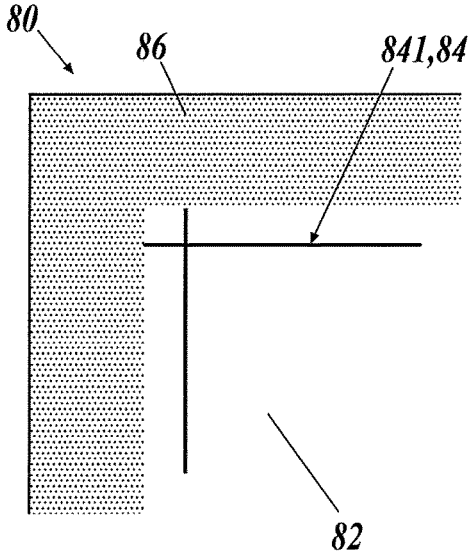
FIG. 6B is an enlarged view of a duplex alignment mark formed in the upper left of a sheet.

FIG. 3 to FIG. 5 illustrates one side of the sheet 80 on which the trim marks 83, the duplex alignment marks 84 and the gradation adjustment marks 85 are formed in the margin area 82 formed around the image area 81 of a predetermined image. FIG. 4 illustrates the case in which the image area 81 is small relative to the size of the sheet 80, and FIG. 5 illustrates the case in which the image area 81 is large relative to the size of the sheet 80. When the image area 81 is small relative to the size of the sheet 80 as illustrated in FIG. 4, the size of the margin area 82 is large. In contrast, when the image area is large relative to the size of the sheet 80 as illustrated in FIG. 5, the size of the margin area 82 is small. FIG. 6A and FIG. 6B are enlarged views of a duplex alignment mark 84 formed in the upper left of the sheet 80, where FIG. 6A illustrates the case in which the trimming area 86 is narrow, and FIG. 6B illustrates the case in which the trimming area 86 is wide. In the embodiment, the sheet 80 is conveyed in the longitudinal direction of the sheet 80.

The trim mark adder 20 adds trim mark information to the image data so that the trim marks 83 are formed at the trimming position on the sheet 80 on which the image based on the image data is formed. The sheet 80 with the trim marks 83 formed thereon is trimmed with reference to the trim marks 83 outside the image forming system 1 so that the margin area 82 is removed.

As illustrated in FIG. 3 to FIG. 5, two or more trim marks 83 are formed on either side of the sheet 80 in the margin area 82 between the image area 81 and the edge of the sheet 80. Among the trim marks 83, trim marks 831 are formed respectively at four locations near the four corners of the image area 81, and trim marks 832 are formed respectively at two locations at the center in the longitudinal direction of the sheet 80 (sheet conveyance direction) on both sides across the image area 81. The area surrounded by the four trim marks 831 defines the trimming position of the sheet 80.

The duplex alignment mark adder 30 adds duplex alignment mark information to the image data so that the duplex alignment marks 84 are formed in the margin area 82 between the edge of the sheet and the trimming position on each side of the sheet on which the image based on the image data is formed.

Two or more duplex alignment marks 84 are formed in the margin area 82 on each of the front and back sides of the sheet 80. As illustrated in FIG. 3 and FIG. 4, among the duplex alignment marks 84, duplex alignment marks 841 are formed respectively at four locations near the four corners of the sheet 80, and duplex alignment marks 842 are formed respectively at two locations in the center in the longitudinal direction of the sheet 80 (sheet conveyance direction) on both sides across the image area 81. The duplex alignment marks 842 are formed closer to the edge of the sheet 80 than the trim marks 832.

Further, the duplex alignment mark adder 30 adds the duplex alignment mark information to the image data so that the duplex alignment marks 84 are formed with reference to the edge of the sheet 80, i.e. at a predetermined distance from the edge. Accordingly, even when the margin area 82 is large as illustrated in FIG. 4, the duplex alignment marks 84 are formed within a predetermined distance range from the edge of the sheet 80. This results in a short measuring distance measured by means of the reading apparatus 50 (described below), and degradation of the measurement accuracy of the line scanner or the like can therefore be reduced.

Further, the duplex alignment mark adder 30 adds the duplex alignment mark information to the image data so that the duplex alignment marks 84 are formed closer to the trimming position than to the edge of the sheet 80 in the margin area 82. Specifically, the duplex alignment mark adder 30 adds the duplex alignment mark information so that the two line segments of a cross-shaped duplex alignment mark 84 extend longer toward the trimming position as illustrated in FIG. 6A and FIG. 6B.

This ensures that the line segments are sufficient for a detection of the duplex alignment marks 84 by means of the reading apparatus 50 even when a part of the duplex alignment marks 84 is not formed due to the trimming area 86 defined in the sheet 80 as illustrated in FIG. 6A and FIG. 6B. As used herein, the trimming area refers to the area within several millimeters from the edge of a sheet where none of the image, the marks and the like is formed. The range from the edge of a sheet is changeable by a user operation. Even when the trimming area 86 is expanded as illustrated in FIG. 6B, it is possible to make a detection of the duplex alignment marks 84 more reliably since the duplex alignment marks 84 are formed close to the trimming position. The trimming area 86 provided in the sheet 80 can prevent the sheet 80 from being winded in a fixing step. This effect is particularly remarkable when the trimming area 86 is provided in the front end in the conveyance direction of the sheet 80.

The gradation adjustment mark adder 40 adds gradation adjustment mark information to the image data so that the gradation adjustment marks 85 are formed in the margin area 82 between the trimming position and the edge of the sheet on which the image based on the image data is formed.

Two or more gradation adjustment marks 85 are formed in the margin area 82 on either side of the sheet 80. The gradation adjustment marks 85 are formed at a predetermined distance from the edge of the sheet 80. Accordingly, the measurement by means of the reading apparatus 50 is made always at the same position. Even in case the density of colors varies depending on the forming position of the gradation adjustment marks 85, the density can be detected at high accuracy. As illustrated in FIG. 3 to FIG. 5, the gradation adjustment marks 85 are formed respectively for C, M, Y and K colors.

Further, the gradation adjustment mark adder 40 adds the gradation adjustment mark information to the image data so that the gradation adjustment marks 85 are formed in both ends in the direction perpendicular to the sheet conveyance direction in the margin area 82 of the sheet 80. While the gradation adjustment marks 85 may be formed anywhere in the margin area 82 of the sheet 80, it is preferred that they are formed in the ends in the direction (transverse direction) perpendicular to the sheet conveyance direction of the sheet 80. This can prevent the sheet 80 from being winded in a fixing step more reliably.

Each of the gradation adjustment marks 85 is composed of gradation patches with gradually different gradation levels of C, M, Y or K. The gradation patches, each of which has a square shape with approximately 7 mm sides for example, are aligned in the conveyance direction of the sheet 80. When the density gradation level of a certain color of a pixel is represented by a value from 0 to 255, the density gradation level of the aligned gradation patches of each gradation adjustment mark 85 is selected from the values from 0 to 255 such that the difference in density gradation level between any adjacent two gradation patches is equal, and the gradation patches at both ends respectively have density gradation levels of 0 and 255.

The gradation patches of the gradation adjustment marks 85 may be formed not only for each of C, M, Y and K colors but also for each of R, G and B colors or for process Bk.

When the image area 81 is large relative to the size of the sheet 80 as illustrated in FIG. 5, the gradation adjustment marks 85 are placed between the trim marks 831 in the conveyance direction of the sheet 80. In this case, the gradation adjustment mark adder 40 adds the gradation adjustment mark information to the image data so that either end of each gradation adjustment mark 85 is located in the center in the sheet conveyance direction of the sheet 80.

Accordingly, the gradation adjustment marks 85 are formed closer to the center than to the both ends in the conveyance direction of the sheet 80. This can prevent the gradation adjustment marks 85 from overlapping the trim marks 831 that are formed in both ends in the conveyance direction of the sheet 80.

Specifically, the gradation adjustment mark adder 40 adds the gradation adjustment mark information so that the ends of two gradation adjustment marks 85 of different colors are located in the center in the conveyance direction of the sheet 80 as illustrated in FIG. 3 to FIG. 5. That is, the two gradation adjustment marks 85 of different colors are aligned in a line across the center in the conveyance direction of the sheet 80.

The hardware processor 70, which is connected to the components of the image forming system 1 as illustrated in FIG. 2, controls the components of the image forming system 1. The hardware processor 70 includes a CPU 71, a RAM 72, a ROM 73 and the like. The CPU 71 reads out programs and data from a storage device such as the ROM 73 and executes them according to required processing, so as to control the components of the image forming system 1 according to the executed processing. The RAM 72 temporary stores programs, data and the like that are processed in the CPU 71. The ROM 73 stores programs, data and the like that have been read out by the CPU 71 or the like.

The hardware processor 70 aligns the positions of the images that are formed on both sides of the sheet 80 by the image forming device 18. That is, the hardware processor 70 controls the image forming device 18 to form the duplex alignment marks 84 on the sheet 80 and then controls the first sensor 53, the second sensor 54 and the reading section 55 of the reading apparatus 50 to read the duplex alignment marks 84 formed on the sheet 80. The hardware processor 70 performs the duplex alignment of the images formed on the both sides of the sheet 80 by calculating a correction value from the amount of deviation from the design values of the duplex alignment marks 84 formed on the front and back sides of the sheet 80 and by adjusting the image forming positions in the two sides based on the correction value.

Further, the hardware processor 70 can also perform gradation adjustment (calibration) of the colors of the image formed by the image forming device 18. That is, the hardware processor 70 controls the image forming device 18 to form the gradation adjustment marks 85 on the sheet 80 and then controls the first sensor 53, the second sensor 54 and the reading section 55 of the reading apparatus 50 to read the gradation adjustment marks 85 formed on the sheet 80. The hardware processor 70 performs the gradation adjustment by calculating correction values from the values read by the reading apparatus 50 and by updating the gradation correction table based on the correction values.

As described above, the hardware processor 70 calculates the correction value for the duplex alignment and the correction values for the gradation adjustment for each sheet 80. When these correction values are accumulated for two or more sheets 80 (e.g. n sheets (n being an integer of 1 or more)), the hardware processor 70 calculates the respective averages thereof. Further, the hardware processor 70 performs the duplex alignment or the gradation adjustment by providing adjustment values based on the calculated averages to the image processing section 17 as feedback at a suitable time. There may be a time lag until the duplex alignment or the gradation adjustment is effected, and it is not always required that the alignment or the adjustment is finished before an image is formed on the n+1th sheet 80. When the number of sets of accumulated correction values for the duplex alignment or the gradation adjustment is less than the number n of sheets 80, the average of the currently accumulated correction values may be calculated.

When the image area 81 is large relative to the size of the sheet 80 as illustrated in FIG. 5, the margin area 82 is small accordingly. When the size of the margin area 82 is small, the trim marks 83, the duplex alignment marks 84 and the gradation adjustment marks 85 may overlap each other. In such cases, the hardware processor 70 forms these marks in the following manner.

When the duplex alignment marks 84 or the gradation adjustment marks 85 to be formed on the sheet 80 are expected to overlap the trim marks 831 to be formed on the corners of the image, the hardware processor 70 controls the duplex alignment mark adder 30 or the gradation adjustment mark adder 40 not to add the duplex alignment mark information or the gradation adjustment mark information at least in the part where the duplex alignment marks 84 or the gradation adjustment marks 85 are expected to overlap the trim marks 831. That is, the trim marks 831 are preferentially formed.

When the duplex alignment marks 84 are expected to overlap the trim marks 831 and the trim marks 831 are therefore preferentially formed as described above, the hardware processor 70 performs the duplex alignment of images by controlling the image forming device 18 to form the trim marks 831 on both sides of the sheet 80 and by specifying the coordinates of the forming positions thereof based on the result of scanning the trim marks 831 by means of the reading apparatus 50. The trim marks 831 that are formed overlapping the position of the duplex alignment marks 84 are located sufficiently close to the edge of the sheet 80. Accordingly, even when the duplex alignment of images are performed by using the result of scanning the trim marks 831, degradation of the measurement accuracy that is due to the properties of the line scanner does not occur. Therefore, the duplex alignment can be performed at high accuracy.

The trim marks 831 may be preferentially formed such that the duplex alignment marks 84 or the gradation adjustment marks 85 are not formed only in the part overlapping the trim marks 831. Alternatively, they may be preferentially formed such that the whole duplex alignment marks 84 or the whole gradation adjustment marks 85 are not formed.

When the duplex alignment marks 84 or the gradation adjustment marks 85 to be formed on the sheet 80 are expected to overlap the trim marks 832 to be formed in the center in the sheet conveyance direction of the sheet 80, the hardware processor 70 controls the trim mark adder 20 not to add the trim mark information at lease in the part where the trim marks 832 overlaps the duplex alignment marks 84 or the gradation adjustment marks 85. That is, the duplex alignment marks 84 and the gradation adjustment marks 85 are preferentially formed. Since the trimming position of the sheet 80 is defined by the four trim marks 831, the sheet 80 can be trimmed even when the trim marks 832 in the center in the sheet conveyance direction of the sheet 80 are not formed.

The duplex alignment marks 84 and the gradation adjustment marks 85 may be preferentially formed such that the trim marks 832 are not formed only in the part overlapping the duplex alignment marks 84 or the gradation adjustment marks 85. Alternatively, they may be preferentially formed such that the whole trim marks 832 are not formed.

As described above, the gradation adjustment mark adder 40 adds the gradation adjustment mark information so that either end of each of the gradation adjustment mark are located in the center in the sheet conveyance direction of the sheet 80. Nevertheless, when the gradation adjustment marks 85 are still expected to overlap the trim marks 831, the hardware processor 70 reduces the number of gradation patches in the gradation adjustment marks 85. To be more specific, the hardware processor 70 calculates the reduced number N of gradation patches (N being an integer of 0 or more) that is required for avoiding the overlap between the gradation adjustment marks 85 and the trim marks 831. When the value N is equal to or greater than the minimum number of gradation patches required for the gradation adjustment, the number of gradation patches is reduced to N. When the value N is less than the minimum number of gradation patches required for the gradation adjustment, the hardware processor 70 deletes all of the gradation patches, i.e. controls the gradation adjustment mark adder 40 not to add the gradation adjustment mark information so that the gradation adjustment marks 85 are not formed.

When the number of gradation patches are reduced to N, the hardware processor 70 sets the density of the gradation patches so that the difference in gradation level between any adjacent gradation patches is equal.

As a result, even when the image area 81 is large relative to the size of the sheet 80, it is possible to perform the gradation adjustment while indicating the trimming position.

As illustrated in FIG. 1, the reading apparatus 50 is disposed in the downstream in the sheet conveyance direction of the sheet finishing apparatus 60. For example, the reading apparatus 50 includes a first conveyance section 51, a second conveyance section 52, a first sensor 53, a second sensor 54, a reading section 55 and the like. When images are formed on both sides of a sheet by the image forming device 18, the reading apparatus 50 can scan both sides at the same time by means of the first sensor 53 and the second sensor 54. The result of scanning the duplex alignment marks 84 and the gradation adjustment marks 85 by the reading apparatus 50 is stored in the storage section 12 or the RAM 72 of the hardware processor 70 and is analyzed by the hardware processor 70.

The first conveyance section 51 includes a pair of upper and lower conveyance guides (not shown) that receives a sheet conveyed from the sheet finishing apparatus 60, conveyance roller pairs 511 that nip and convey the received sheet, and the like. The first conveyance section 51 conveys a sheet to the downstream at a predetermined conveyance speed. Among the conveyance roller pairs 511, the conveyance roller pairs disposed in the upstream and the downstream of the first sensor 53 nip and convey a sheet at a predetermined nipping pressure that is higher than the nipping pressure of the other conveyance roller pairs 511. This allows stably nipping the sheet while the first sensor 53 is reading an image, and a reading error is therefore prevented.

Three conveyance roller pairs 511 are provided in the example of FIG. 1, but the number of the conveyance roller pairs 511 is not limited thereto.

The second conveyance section 52 includes a pair of upper and lower conveyance guides (not shown) that receives a sheet conveyed from the first conveyance section 51, conveyance roller pairs 521 that nip and convey the received sheet, and the like. The second conveyance section 52 conveys a sheet to the downstream at a predetermined conveyance speed. Among the conveyance roller pairs 521, the conveyance roller pairs 521 that are disposed in the upstream and the downstream of the second sensor 54 and in the upstream and the downstream of the reading section 55 nip and convey a sheet at a predetermined nipping pressure that is higher than the nipping pressure of the other conveyance roller pairs 521. This allows stably nipping a sheet while the second sensor 54 or the reading section 55 reads an image, and a reading error is therefore prevented.

Four conveyance roller pairs 521 are provided in the example of FIG. 1, but the number of the conveyance roller pairs 521 is not limited thereto.

The first sensor 53, which is disposed in the first conveyance section 51, reads the image of a sheet passing through the first conveyance section 51 from below.

For example, the first sensor 53 is constituted by an optical sensor that can read an image at relatively high speed such as a line scanner. The first sensor 53 reads the image formed on a sheet so as to output respective read signals of R, G and B colors. The first sensor 53 that is constituted by a sensor that can read an image at relatively high speed such as a line scanner can read the image formed on a sheet at a faster speed than the reading section 55 that is constituted by a colorimeter (described below). Further, the first sensor can read a wider range in the width direction of a sheet compared to the reading section 55 described below, or it can even read the full width of a sheet.

The second sensor 54, which is disposed in the second conveyance section 52, reads the image on a sheet passing though the second conveyance section 52 from above. The second sensor 54 has the same configuration as the first sensor 53.

The reading section 55, which is disposed in the downstream in the sheet conveyance direction of the second sensor 54 in the second conveyance section 52, reads the image on a sheet passing through the second conveyance section 52 from above.

The reading section 55 is constituted by a colorimeter that spectroscopically measures the color of each gradation patch of the gradation adjustment marks 85 for respective colors so as to obtain a colorimetric data. The colorimetric data includes the color of each gradation patch which is represented by a colorimetric system that is independent of the device, such as the XYZ colorimetric system. The reading section 55 has a slower reading speed and a narrower readable range in the width direction of a sheet compared to the first sensor 53 and the second sensor 54 but can obtain a more precise colorimetric data.

As illustrated in FIG. 1, the sheet finishing apparatus 60 is disposed between the image forming apparatus 10 and the reading apparatus 50. The sheet finishing apparatus 60 performs the following finishing processes on a sheet conveyed from the image forming apparatus 10. That is, the sheet finishing apparatus 60 moisturizes a sheet that is curved (e.g. rippled) due to a heating step such as the fixing step and nips the moisturized sheet from both sides while conveying it, so as to correct the curvature of the sheet. The sheet finishing apparatus 60 can also convey a sheet to the downstream without moisturizing and correcting it.

In the following, an example of the image formation processing that is executed by the hardware processor 70 in the image forming system 1 with the above-described configuration will be described referring to FIG. 7.

FIG. 7 is a flowchart of an example of the image formation processing performed on a sheet 80.

First, the hardware processor 70 controls the image generating section 16 to generate the image data of an image to be formed on the sheet 80 (Step S101).

Then, the hardware processor 70 makes a determination as to whether to form the trim marks 83 (Step S102). Specifically, the hardware processor 70 makes the determination based on whether there is an input of a user operation of forming or not forming the trim marks 83. Alternatively, the hardware processor 70 may make a determination as to whether the trim mark information has already been added to the image data. In this case, if it is determined that the trim mark information has already been added to the image data, the hardware processor 70 determines not to form additional trim marks.

If it is determined to form the trim marks 83 (Step S102, Yes), the hardware processor 70 controls the trim mark adder 20 to add the trim mark information to the image data formed in Step S101 (Step S103).

If it is determined not to form the trim marks 83 (Step S102, No), the hardware processor 70 does not perform the control of adding trim mark information to the image data, and the processing continues with Step S104.

Then, the hardware processor 70 makes a determination as to whether to form the duplex alignment marks 84 (Step S104). Specifically, the hardware processor 70 makes the determination based on whether there is an input of a user operation of forming or not forming the duplex alignment marks 84.

If it is determined to form the duplex alignment marks 84 (Step S104, Yes), the hardware processor 70 makes a determination as to whether the duplex alignment marks 84 are expected to overlap the corner trim marks 831 (Step S105).

If it is determined not to form the duplex alignment marks 84 (Step S104, No), the hardware processor 70 skips Step S105 and Step S106 so that the duplex alignment mark information is not added to the image data, and the processing continues with Step S107 described below.

If it is determined that the duplex alignment marks are expected not to overlap with the trim marks 831 (Step S105, No), the hardware processor 70 controls the duplex alignment mark adder 30 to add the duplex alignment mark information to the image data to which the trim mark information has been added (Step S106).

If it is determined that the duplex alignment marks 84 are expected to overlap the trim marks 831 (Step S105, Yes), the hardware processor 70 skips Step S106 so that the duplex alignment mark information is not added to the image data, and the processing continues with Step S107.

Then, the hardware processor 70 makes a determination as to whether to form the gradation adjustment marks 85 (Step S107). Specifically, the hardware processor 70 makes the determination based on whether there is an input of a user operation of forming or not forming the gradation adjustment marks 85.

If it is determined to form the gradation adjustment marks 85 (Step S107, Yes), the hardware processor 70 makes a determination as to whether the gradation adjustment marks 85 are expected to overlap the trim marks 831 (Step S108).

If it is determined not to form the gradation adjustment marks 85 (Step S107, No), the hardware processor 70 skips Step S108 to Step S112 so the gradation adjustment mark information is not added to the image data, and the processing continues to Step S113 described below.

If it is determined that the gradation adjustment marks 85 are expected not to overlap the trim marks 831 (Step S108, No), the hardware processor 70 skips Step S109 to Step S111, and the processing continues with Step S112.

If it is determined that the gradation adjustment marks 85 are expected to overlap the trim marks 831 (Step S108, Yes), the hardware processor 70 calculates the number N of gradation patches of each gradation adjustment mark 85, which is the reduced number of gradation patches required for avoiding the overlap between the gradation adjustment marks 85 and the trim marks 831 (Step S109).

Then, the hardware processor 70 makes a determination as to whether the number N of gradation patches calculated in Step S109 is equal to or greater than the minimum number of gradation patches required for the gradation adjustment (Step S110). For example, the minimum number of gradation patches required for the gradation adjustment may be set to "3". In this case, the gradation level of the three gradation patches is set respectively to 0, 128 and 255. However, the minimum number of gradation patches is not limited thereto and may be suitably set according to the size and shape of the trim marks 831 and gradation patches.

If it is determined that the number N of gradation patches calculated in Step 109 is equal to or greater than the minimum number of the gradation patches (Step S110, Yes), the hardware processor 70 reduces the gradation patches so that the number of gradation patches of the gradation adjustment marks 85 is reduced to N (Step S111).

If it is determined that the number N of gradation patches is less than the minimum number of gradation patches (Step S110, No), the hardware processor 70 skips Step S111 and Step S112, and the processing continues with Step S113. That is, when the minimum number of gradation patches is "3" and the number N of gradation patches is from 0 to 2 for example, the hardware processor 70 controls the gradation adjustment mark adder 40 not to add the gradation adjustment mark information since it is impossible to perform a sufficient gradation adjustment.

Then, the hardware processor 70 controls the gradation adjustment mark adder 40 to add the gradation adjustment mark information to the image data to which the trim mark information has been added (Step S112). If it is determined in Step S108 that the gradation adjustment marks 85 are expected not to overlap the trim marks 831, the gradation adjustment marks 85 are formed without reducing the number of gradation patches. If it is determined in Step S108 that the gradation adjustment marks 85 are expected to overlap the trim marks 831, the gradation adjustment marks 85 each composed of reduced N gradation patches are formed.

Finally, the hardware processor 70 controls the image forming device 18 to form the image on the sheet 80 (Step S113). The hardware processor 70 controls the reading apparatus 50 to read the formed image and then performs the duplex alignment and the gradation adjustment based on the result of scanning the duplex alignment marks 84 and the gradation adjustment marks 85.

In this way, the image formation processing is performed.

In the above-described embodiment, the image forming apparatus 10 includes the image forming device 18 capable of forming an image on both sides of a sheet 80 based on the image data, the trim mark adder 20 that adds the trim mark information to the image data so that the trim marks 83 are added at the trimming position in the sheet 80 on which the image is formed based on the image data, the duplex alignment mark adder 30 that adds the duplex alignment mark information to the image data so that the duplex alignment marks 84 are added in the margin area 82 between the edge of the sheet and the trimming position in both sides of the sheet 80 on which the image is formed based on the image data, and the hardware processor 70 that performs duplex alignment of the image data based on the result of scanning the duplex alignment marks 84, in which the reading apparatus 50 that reads the image formed on the sheet 80 scans the duplex alignment marks 84. Therefore, the duplex alignment can be performed by using the duplex alignment marks 84 that are formed in the margin area 82 outside the trim marks 83 in the sheet 80. This enables performing the duplex alignment of images at high accuracy without producing a waste sheet.

The duplex alignment mark adder 30 adds the duplex alignment mark information to the image data so that the duplex alignment marks 84 are added at the predetermined distance from the edge of the sheet. Therefore, the duplex alignment marks 84 can be formed within a predetermined distance range from the edge of the sheet regardless of the size of the image area 81 relative to the size of the sheet 80. This enables performing the duplex alignment at even higher accuracy since such a short measuring distance by means of the reading apparatus 50 enables reading the duplex alignment marks 84 at high accuracy.

The image forming apparatus 10 further includes the gradation adjustment mark adder 40 that adds the gradation adjustment mark information to the image data so that the gradation adjustment marks 85 are formed in the margin area 82 of the sheet 80 on which the image is formed based on the image data, and the hardware processor 70 performs the gradation adjustment based on the result of scanning the gradation adjustment marks 85 by means of the reading apparatus 50. Therefore, an adjustment of the color gradation of the image can be performed in addition to the above-described duplex alignment of the images.

The gradation adjustment mark adder 40 adds the gradation adjustment mark information to the image data so that the gradation adjustment marks 85 are formed in the margin area 82 in both ends in the direction perpendicular to the sheet conveyance direction of the sheet 80. Therefore, the gradation adjustment marks 85 are not formed in the margin area 82 in both ends in the sheet conveyance direction of the sheet 80, which can prevent the sheet 80 from being winded in the fixing step. As a result, imperfect fixing can be prevented.

The gradation adjustment mark adder 40 adds the gradation adjustment mark information to the image data so that either end of each of the gradation adjustment marks is located in the center in the sheet conveyance direction of the sheet 80. Therefore, the gradation adjustment marks 85 can be prevented from overlapping the trim marks 831.

The hardware processor 70 is configured such that when the duplex alignment marks 84 or the gradation adjustment marks 85 are expected to overlap the trim marks 831 formed in the corners of the image, it controls the duplex alignment mark adder 30 or the gradation adjustment mark adder 40 not to add the duplex alignment mark information or the gradation adjustment mark information at least in the part where the duplex alignment marks 84 or the gradation adjustment marks 85 are expected to overlap the trim marks 831. Further, the hardware processor 70 is configured such that when the duplex alignment marks 84 or the gradation adjustment marks 85 are expected to overlap the trim marks 832 formed in the center in the sheet conveyance direction of sheet 80, it controls the trim mark adder 20 not to add the trim mark information at least in the part where the trim marks 832 are expected to overlap the duplex alignment marks 84 or the gradation adjustment marks 85. Therefore, even when the image area 81 is large relative to the size of the sheet 80 and the margin area 82 is small accordingly, it is possible to perform the duplex alignment or the gradation adjustment while indicating the trimming position of the sheet 80.

When the duplex alignment marks 84 or the gradation adjustment marks 85 are expected to overlap the trim marks 831 formed in the corners of the image, the hardware processor 70 controls the duplex alignment mark adder 30 or the gradation adjustment mark adder 40 not to add the duplex alignment mark information or the gradation adjustment mark information at least in the part where the duplex alignment marks 84 or the gradation adjustment marks 85 are expected to overlap the trim marks 831. In this case, the hardware processor 70 performs the duplex alignment of the image data by specifying the coordinates of the forming position based on the result of the reading apparatus 50 scanning the trim marks 831 formed in the corners of the image. Therefore, even when the duplex alignment marks 84 are not formed, it is possible to perform the duplex alignment at high accuracy while indicating the trimming position in the sheet 80.

Each of the gradation adjustment marks 85 is composed of the gradation patches, and the hardware processor 70 is configured such that when the gradation adjustment marks 85 are expected to overlap the trim marks 831 formed in the corners of the image, it reduces the number of gradation patches. Therefore, it is possible to perform the gradation adjustment while avoiding an overlap between the gradation adjustment marks 85 and the trim marks 831.

The duplex alignment mark adder 30 adds the duplex alignment mark information to the image data so that the duplex alignment marks 84 are formed in the margin area 82 closer to the trimming position than to the edge. Therefore, even when a part of the duplex alignment marks 84 are not formed due to the trimming area 86 set in the sheet 80, it is possible to perform the duplex alignment since sufficient line segments are ensured for the detection of the duplex alignment marks 84 by means of the reading apparatus 50.

The above-described embodiment is merely a preferred example of the present invention, and the present invention is not limited thereto. Suitable changes can be made without departing from the spirit of the present invention.

For example, in the above-described embodiment, the image forming system 1 is configured such that the reading apparatus 50 is provided outside the image forming apparatus 10. However, the reading apparatus 50 may be incorporated in the image forming apparatus 10.

In the above-described embodiment, the gradation adjustment mark adder 40 is provided, and the gradation adjustment is performed based on the result of scanning the gradation adjustment marks 85. However, the gradation adjustment mark adder 40 may not be provided.

In the above-described embodiment, the gradation adjustment marks 85 are formed in the margin area 82 of the sheet 80 in the both ends in the direction perpendicular to the sheet conveyance direction of the sheet 80. However, the gradation adjustment marks 85 may be formed in the margin area 82 in both ends in the sheet conveyance direction of the sheet 80.

In the above-described embodiment, the gradation adjustment marks 85 are formed such that an end of each gradation adjustment mark 85 is located in the center in the sheet conveyance direction of the sheet 80. However, the gradation adjustment marks 85 may be formed such that an end of each gradation adjustment mark 85 is located in an end in the sheet conveyance direction of the sheet 80.

In the above-described embodiment, the number of gradation patches is reduced when the gradation adjustment marks 85 are expected to overlap the trim marks 831 formed in the corners of the image. However, the gradation adjustment marks 85 may not be formed in this case.

In the above-described embodiment, the duplex alignment marks 84 are formed in the margin area 82 closer to the trimming position than to the edge of the sheet 80. However, the duplex alignment marks 84 may be formed closer to the edge of the sheet 80.

In the above-described embodiment, the hardware processor 70 controls the operation of the components of the image forming system 1. However, another hardware processor may be separately provided to control the operation of the reading apparatus 50 or the sheet finishing apparatus 60.

In the above-described embodiment, no component is provided in the downstream in the sheet conveyance direction of the reading apparatus 50. However, for example, a sheet finishing apparatus (not shown) may be further provided which performs sheet finishing such as stapling, punching, folding and binding. Such sheet finishing by the sheet finishing apparatus is not essentially performed but is performed only when there is a command from the hardware processor 70. When there is no command from the hardware processor 70 and no sheet finishing is performed accordingly, the sheet finishing apparatus simply ejects a conveyed sheet.

In the above-described embodiment, the reading apparatus 50 reads the duplex alignment marks and the gradation adjustment marks. However, the reading apparatus 50 may read the image and other marks formed on the sheet 80.

In the above-described embodiment, the first sensor 53 reads the image on a sheet from below, and the second sensor 54 and the reading section 55 read the image on a sheet from above. On the contrary, the first sensor 53 may read the image on a sheet from above, and the second sensor 54 and the reading section 55 may read the image on a sheet from below.

In the above-described embodiment, a hard disk, a non-volatile semiconductor memory and the like are disclosed as examples of a computer-readable medium for the program according to the present invention. However, the present invention is not limited to these examples. Other computer-readable media, e.g. portable recording media such as a CD-ROM, are also applicable. Further, a carrier wave is also applicable as a medium for providing the data of the program according to the present invention through a communication network.

This U.S. patent application claims priority to Japanese patent application No. 2015-155601 filed on Aug. 6, 2015, the entire contents of which are incorporated by reference herein for correction of incorrect translation.

What is claimed is:

1. An image forming apparatus, comprising:

an image forming device which is capable of forming an image on both sides of a sheet based on an image data;

a trim mark adder which adds trim mark information to the image data so that a trim mark is formed at a trimming position of the sheet on which the image is formed based on the image data;

a duplex alignment mark adder which adds duplex alignment mark information to the image data so that a duplex alignment mark is formed in a margin area between an edge of the sheet and the trimming position on both sides of the sheet to which the image is formed based on the image data;

a hardware processor which performs a duplex alignment of the image data based on a result of scanning the duplex alignment mark, in which a scanning section which reads the image formed on the sheet scans the duplex alignment mark.

2. The image forming apparatus according to claim 1, wherein the duplex alignment mark adder adds the duplex alignment mark information to the image data so that the duplex alignment mark is formed at a predetermined distance from the edge of the sheet.

3. The image forming apparatus according to claim 1, further comprising:

a gradation adjustment mark adder which adds gradation adjustment mark information to the image data so that a gradation adjustment mark is formed in the margin area in the sheet on which the image is formed based on the image data, wherein the hardware processor performs gradation adjustment based on a result of the scanning section scanning the gradation adjustment mark.

4. The image forming apparatus according to claim 3, wherein the gradation adjustment mark adder adds the gradation adjustment mark information to the image data so that the gradation adjustment mark is formed in the margin area in both ends in the direction perpendicular to a sheet conveyance direction of the sheet.

5. The image forming apparatus according to claim 4, wherein the gradation adjustment mark adder adds the gradation adjustment mark information to the image data so that an end of the gradation adjustment mark is formed in a center in the sheet conveyance direction of the sheet.

6. The image forming apparatus according to claim 3, wherein when the duplex alignment mark or the gradation adjustment mark is expected to overlap the trim mark that is formed in a corner of the image, the hardware processor controls the duplex alignment mark adder or the gradation adjustment mark adder not to add the duplex alignment mark information or the gradation adjustment mark information at least in the part where the duplex alignment mark or the gradation adjustment mark is expected to overlap the trim mark, and wherein when the duplex alignment mark or the gradation adjustment mark is expected to overlap the trim mark that is formed in a center in the sheet conveyance direction of the sheet, the hardware processor controls the trim mark adder not to add the trim mark information at least in the part where the trim mark is expected to overlap the duplex alignment mark or the gradation adjustment mark.

7. The image forming apparatus according to claim 6, wherein when the duplex alignment mark or the gradation adjustment mark is expected to overlap the trim mark that is formed in the corner of the image and the duplex alignment mark adder or the gradation adjustment mark adder does not add the duplex alignment mark information or the gradation adjustment mark information at least in the part where the duplex alignment mark or the gradation adjustment mark is expected to overlap the trim mark, the hardware processor performs the duplex alignment of the image data by specifying a coordinate of a forming position of the image based on a result of the scanning section scanning the trim mark that is formed in the corner of the image.

8. The image forming apparatus according to claim 3, wherein the gradation adjustment mark is composed of gradation patches, and wherein when the gradation adjustment mark is expected to overlap the trim mark that is formed in a corner of the image, the hardware processor reduces the number of the gradation patches.

9. The image forming apparatus according to claim 1, wherein the duplex alignment mark adder adds the duplex alignment mark information to the image data so that the duplex alignment mark is formed in the margin area closer to the trimming position than to the edge.

10. A non-transitory computer readable medium storing a program that makes a computer of an image forming apparatus capable of forming an image on both sides of a sheet according to an image data function as:

a trim mark adder which adds trim mark information to the image data so that a trim mark is formed at a trimming position of the sheet on which the image is formed based on the image data;

a duplex alignment mark adder which adds duplex alignment mark information to the image data so that a duplex alignment mark is formed in a margin area between an edge of the sheet and the trimming position on both sides of the sheet on which the image is formed based on the image data; and a hardware processor which performs a duplex alignment of the image data based on a result of scanning the duplex alignment mark, in which a scanning section which reads the image formed on the sheet scans the duplex alignment mark.

11. The non-transitory computer readable medium according to claim 10, wherein the duplex alignment mark adder adds the duplex alignment mark information to the image data so that the duplex alignment mark is formed at a predetermined distance from the edge of the sheet.

12. The non-transitory computer readable medium according to claim 10, wherein the program makes the computer further function as:

a gradation adjustment mark adder which adds gradation adjustment mark information to the image data so that a gradation adjustment mark is formed in the margin area in the sheet on which the image is formed based on the image data, wherein the hardware processor performs a gradation adjustment based on a result of the scanning section scanning the gradation adjustment mark.

13. The non-transitory computer readable medium according to claim 12, wherein the gradation adjustment mark adder adds the gradation adjustment mark information to the image data so that the gradation adjustment mark is formed in the margin area in both ends in the direction perpendicular to a sheet conveyance direction of the sheet.

14. The non-transitory computer readable medium according to claim 13, wherein the gradation adjustment mark adder adds the gradation adjustment mark information to the image data so that an end of the gradation adjustment mark is formed in a center in the sheet conveyance direction of the sheet.

15. The non-transitory computer readable medium according to claim 12, wherein when the duplex alignment mark or the gradation adjustment mark is expected to overlap the trim mark that is formed in a corner of the image, the hardware processor controls the duplex alignment mark adder or the gradation adjustment mark adder not to add the duplex alignment mark information or the gradation adjustment mark information at least in the part where the duplex alignment mark or the gradation adjustment mark is expected to overlap the trim mark, and wherein when the duplex alignment mark or the gradation adjustment mark is expected to overlap the trim mark that is formed in a center in the sheet conveyance direction of the sheet, the hardware processor controls the trim mark adder not to add the trim mark information at least in the part where the trim mark is expected to overlap the duplex alignment mark or the gradation adjustment mark.

16. The non-transitory computer readable medium according to claim 15, wherein when the duplex alignment mark or the gradation adjustment mark is expected to overlap the trim mark that is formed in the corner of the image and the duplex alignment mark adder or the gradation adjustment mark adder does not add the duplex alignment mark information or the gradation adjustment mark information at least in the part where the duplex alignment mark or the gradation adjustment mark is expected to overlap the trim mark, the hardware processor performs the duplex alignment of the image data by specifying a coordinate of a forming position of the image based on a result of the scanning section scanning the trim mark that is formed in the corner of the image.

17. The non-transitory computer readable medium according to claim 12, wherein the gradation adjustment mark is composed of gradation patches, and wherein when the gradation adjustment mark is expected to overlap the trim mark that is formed in a corner of the image, the hardware processor reduces the number of the gradation patches.

18. The non-transitory computer readable medium according to claim 10, wherein the duplex alignment mark adder adds the duplex alignment mark information to the image data so that the duplex alignment mark is formed in the margin area closer to the trimming position than to the edge.

* * * * *